US006176548B1

(12) United States Patent
Thole et al.

(10) Patent No.: US 6,176,548 B1
(45) Date of Patent: Jan. 23, 2001

(54) TILT MECHANISM FOR CHAIR HAVING ADJUSTABLE SPRING CHARACTERISTICS

(75) Inventors: Douglas M. Thole, Grand Rapids; Patrick C. Nelson, Holland, both of MI (US)

(73) Assignee: Haworth, Inc., Holland, MI (US)

( * ) Notice: Under 35 U.S.C. 154(b), the term of this patent shall be extended for 0 days.

(21) Appl. No.: 09/177,762

(22) Filed: Oct. 23, 1998

(51) Int. Cl.[7] ..... A47C 1/031

(52) U.S. Cl. ..... 297/302.1; 297/303.1; 297/329

(58) Field of Search ..... 297/302, 302.6, 297/302.7, 302.1, 300.1, 303.1, 325

(56) References Cited

U.S. PATENT DOCUMENTS

| | | | |
|---|---|---|---|
| 9,620 | 3/1853 | TenEyck . | |
| 139,948 | 6/1873 | Doremus . | |
| 144,664 | 11/1873 | Doremus . | |
| 160,764 | 3/1875 | Gardner . | |
| 161,671 | 4/1875 | Doremus . | |
| 215,337 | 5/1879 | Doremus . | |
| 1,216,755 | 2/1917 | Whitten . | |
| 1,732,647 | * 10/1929 | Flintermann | 297/302.5 X |
| 1,747,932 | 2/1930 | Dufaux . | |
| 2,056,965 | 10/1936 | Herold . | |
| 2,087,253 | 7/1937 | Herold . | |
| 2,184,988 | 12/1939 | Collier et al. . | |
| 2,228,719 | 1/1941 | Bolens . | |
| 2,353,737 | 7/1944 | Lorenz . | |
| 2,374,350 | 4/1945 | Herold . | |
| 2,410,871 | 11/1946 | Fields et al. . | |
| 2,779,390 | 1/1957 | Freeman . | |
| 2,787,315 | 4/1957 | Siebert . | |
| 2,796,920 | 6/1957 | Cowles . | |
| 2,799,323 | 7/1957 | Berg . | |
| 2,818,911 | 1/1958 | Syak . | |
| 3,284,133 | 11/1966 | Werner . | |
| 3,309,137 | 3/1967 | Wiebe . | |
| 3,672,721 | 6/1972 | Wiliams . | |
| 3,693,925 | 9/1972 | Weinstein . | |
| 3,740,792 | 6/1973 | Werner . | |
| 3,770,235 | 11/1973 | Klapproth et al. . | |
| 3,826,456 | 7/1974 | Tranter et al. . | |
| 3,863,982 | 2/1975 | Sandham . | |
| 4,027,843 | 6/1977 | Thompson . | |
| 4,077,596 | 3/1978 | Pinaire et al. . | |
| 4,235,471 | 11/1980 | Tengler . | |
| 4,372,606 | 2/1983 | Faull . | |
| 4,455,010 | 6/1984 | Butler . | |
| 4,597,567 | 7/1986 | Racca . | |
| 4,640,548 | 2/1987 | Desanta . | |
| 4,664,445 | 5/1987 | Groseth . | |
| 4,752,101 | 6/1988 | Yurchenco et al. . | |
| 4,852,943 | 8/1989 | Roper . | |
| 4,871,208 | 10/1989 | Hodgdon . | |

(List continued on next page.)

FOREIGN PATENT DOCUMENTS

| | | |
|---|---|---|
| 2 022 525 | 11/1971 | (DE) . |
| 0 574 375 B1 | 12/1993 | (EP) . |
| 33 758 | 3/1929 | (FR) . |
| 1 324 451 | 7/1973 | (GB) . |

*Primary Examiner*—Peter M. Cuomo
*Assistant Examiner*—David E. Allred
(74) *Attorney, Agent, or Firm*—Flynn, Thiel, Boutell & Tanis, P.C.

(57) ABSTRACT

An office chair includes a tilt control mechanism which connects a seat assembly to a base. The tilt control mechanism defines a pivot connection between the seat assembly and the base whereby the seat assembly effectively pivots about a pivot point in any direction extending radially from the pivot point. The tilt control mechanism includes an annular elastomeric ring which resists multi-directional tilting and biases the seat assembly to a neutral position. The elastomeric ring has a contact area on which the tilting moment of the seat assembly acts which contact area can be selectively varied to adjust tilting resistance.

20 Claims, 10 Drawing Sheets

U.S. PATENT DOCUMENTS

| | | |
|---|---|---|
| 4,889,385 | 12/1989 | Chadwick et al. . |
| 4,890,886 | 1/1990 | Opsvik . |
| 4,995,598 | 2/1991 | Ingham . |
| 5,170,997 | 12/1992 | Girard et al. . |
| 5,288,127 | 2/1994 | Berg et al. . |
| 5,409,295 | 4/1995 | Edstrom . |
| 5,573,304 | 11/1996 | Glöckl . |
| 5,649,740 | 7/1997 | Hodgdon . |

* cited by examiner

16

31
60
48
71
83
47
46
57
63
35
53
52
66
55
84
76
75
59
80
77
103
43
38
42
44
86
39
87
96
30
89
34
78

TILT MECHANISM FOR CHAIR HAVING ADJUSTABLE SPRING CHARACTERISTICS

FIELD OF THE INVENTION

This invention relates to an office chair and, in particular, to an adjustable universal tilt mechanism which pivotally connects a seat assembly to a base.

BACKGROUND OF THE INVENTION

Conventional office chairs frequently include a seat-back arrangement which is connected to a base by a tilt mechanism. The tilt mechanism defines one or more pivot axes about which a seat or back assembly may pivot or tilt relative to the base. Office chairs typically tilt rearwardly about fixed horizontal pivot axes wherein the seat and back assemblies are rearwardly tiltable either together or independently. To resist such tilting and bias the seat and back assemblies to normal upright positions, numerous tilt mechanisms have been provided which include springs such as coil, leaf and torsion springs which oppose the tilting movement.

As an alternative to conventional spring arrangements, prior tilt control mechanisms have also used elastomeric pads or rings between relatively moving surfaces. The pads or rings are resilient so as to be compressed between the moving surfaces to resist the tilting movement. Some of these tilt mechanisms permit the seat to pivot in multiple directions.

Examples of chairs using elastomeric pads or rings which permit tilting in multiple directions are disclosed in U.S. Pat. Nos. 139,948, 3,309,137, 4,027,843, and 5,573,304. The U.S. Pat. No. 3,309,137 patent permits adjustment of tilting resistance by varying the compression of an elastomeric ring. The chairs disclosed in the remaining patents do not permit adjustment of the tilting resistance.

In another chair as disclosed in U.S. Pat. No. 4,890,886, the tilt control mechanism defines a fixed pivot axis between the seat assembly and the chair base. The tilt control mechanism further includes a plate secured to the seat assembly so as to move with the seat assembly relative to the base, and a second plate which is spaced apart from the first plate and remains stationary relative to the base. These opposing plates move relative to each other during tilting of the seat assembly, and elastomeric pads are provided between these relatively movable plates to resist tilting and bias the seat assembly to a neutral position. These pads have predetermined and fixed size and shape and therefore, the elastic characteristics of these pads are predefined and constant. To adjust resistance to tilting, the elastomeric pads are movable relative to the pivot axis to thereby adjust the distance defined therebetween. In one embodiment, the pads are vertically movable.

However, users, such as office workers, who sit in such chairs typically move in all directions, such as sidewardly, forwardly and rearwardly when working. Conventional tilt control mechanisms having fixed axes, however, restrict such movement due to the fixed axes, and hence do not readily accommodate the usual movements of a user such as movement to the side.

To more readily accommodate the various movements of a user, the chair of the present invention accommodates movement of a user both forwardly and sidewardly and in fact permits the chair seat to swivel about a connection point so as to react to the user. In particular, to overcome the disadvantages of conventional chair designs which use fixed pivot axes, the chair of the present invention includes a tilt control mechanism which permits universal tilting or swiveling of the seat assembly relative to the base in substantially all horizontal directions. The seat assembly is not restrained by fixed pivot axes but instead effectively pivots about a pivot or connection point. Thus, the seat assembly can pivot forwardly and rearwardly, sidewardly and in any other horizontal direction extending radially away from the pivot point, and can also be swivelled about the connection point. Thus, as a user shifts and moves, the chair reacts to the user's movements while still providing sufficient resistance to the universal tilting movement to provide stability and control for the user.

To provide resistance to such tilting, the tilt control mechanism of the invention includes a vertical support column which is supported on the base and remains stationary. To resist tilting, the support column includes an elastomeric doughnut-shaped ring which is fixed in position on an upper end of the column proximate the pivot connection. The resilient ring has predefined vertical and radial dimensions.

In an embodiment of the invention, the tilt control mechanism includes a cylindrical housing which is disposed in concentric and surrounding relationship to the support column and the resilient ring supported thereon. The housing is movable with the seat assembly during tilting thereof wherein the resilient ring resists movement of the housing relative to the support column.

The resilient ring applies a reaction force on the housing as the housing moves relative to the support column and therefore, biases the housing to return the seat assembly to a normal or neutral position. The resilient ring, however, does not directly contact the housing but instead, an annular sleeve is slidably received in a space defined between the resilient ring and the housing. The adjustment sleeve is close-fittingly received between the resilient ring and the housing such that the resistance force of the resilient ring is transferred to the housing.

The adjustment sleeve furthermore is movable to adjust the resistance to tilting. More particularly, the amount of surface contact between the sleeve and the resilient ring defines the extent of the resilient ring which effectively acts on the housing. Thus, while the resilient ring has a contact surface which has a fixed dimension, only a portion of this contact surface typically acts on the housing depending upon the amount of contact area between the sleeve and the resilient ring or in other words, the amount of the sleeve which is inserted between the resilient ring and the housing.

By varying the amount of surface contact, i.e. the contact area, between the resilient ring and the adjustment sleeve, the effective size of the resilient ring is continuously variable whereby the effective spring characteristic of the resilient ring as it acts on the housing is continuously adjustable. This arrangement, thereby, adjusts tilting resistance by varying the effective spring characteristics of the resilient ring. While the sleeve preferably moves vertically, alternate embodiments are also disclosed herein wherein the sleeve is moved horizontally to vary the contact area between the sleeve and the resilient ring and adjust tilting resistance.

Other objects and purposes of the invention, and variations thereof, will be apparent upon reading the following specification and inspecting the accompanying drawings.

Figure 1:
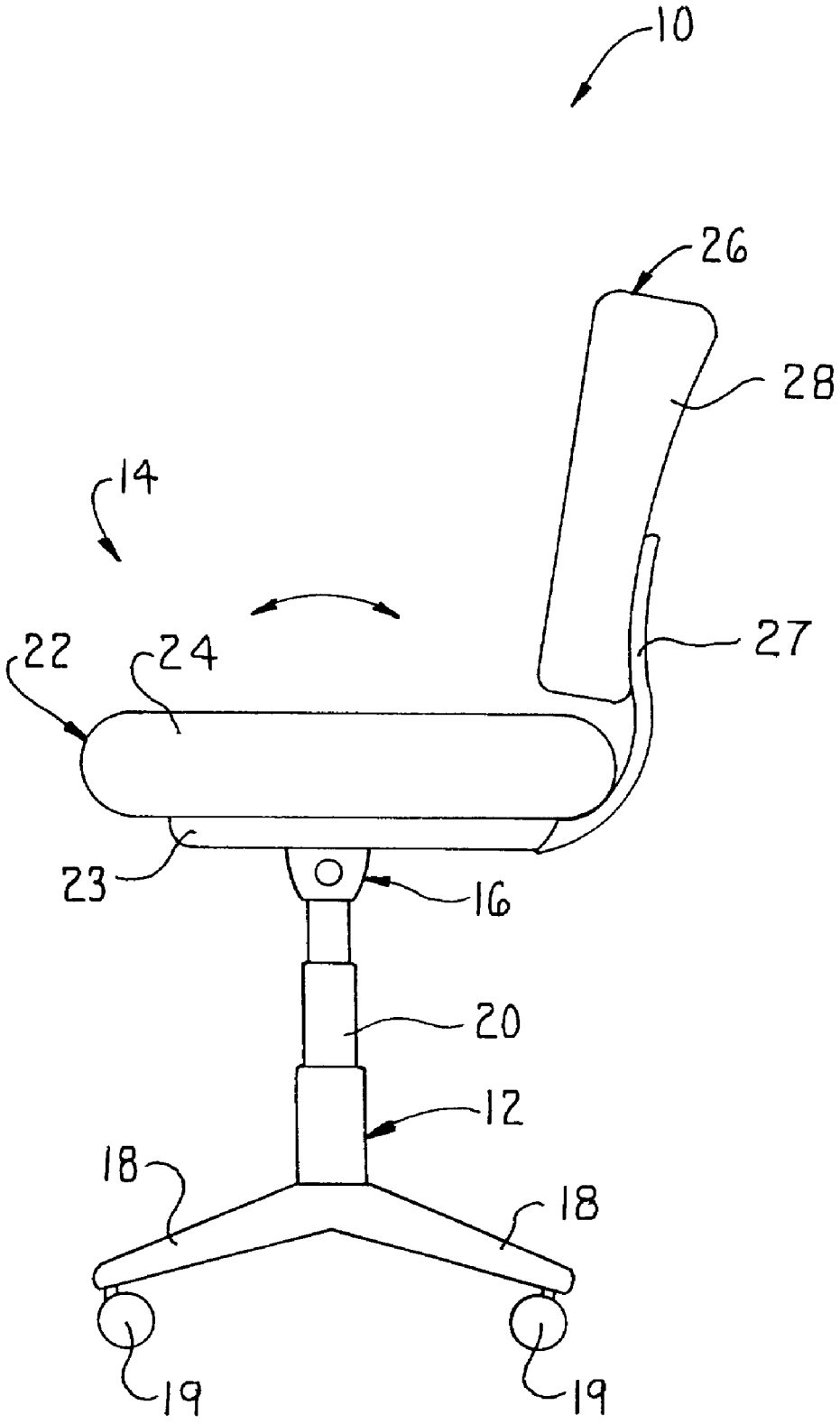
FIG. 1 is a side elevational view of a chair of the invention.

Certain terminology will be used in the following description for convenience and reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the arrangement and designated parts thereof. Said terminology will include the words specifically mentioned, derivatives thereof, and words of similar import.

DETAILED DESCRIPTION

Referring to FIG. 1, the chair 10 of the invention includes a base 12, a seat-back arrangement 14 and a tilt control mechanism which connects the seat-back arrangement 14 to the base 12. The inventive tilt control mechanism 16 not only permits vertical tilting of the seat-back arrangement 14 relative to the base 12 in a forward-rearward direction but effectively in any horizontal direction (i.e. universally) as discussed herein.

The base 12 may be of a conventional construction and, in the illustrated embodiment, includes a plurality of radially extending legs 18 which are supported on a support surface by casters 19. The base 18 further includes a vertically elongate and cylindrical spindle or column 20 which projects upwardly from the legs 18 and supports the tilt control mechanism 16 on the upper end thereof.

The tilt control mechanism 16 also supports the seat-back arrangement 14. The seat-back arrangement 14 may be of any construction and in the illustrated embodiment includes a seat assembly 22 having a rigid housing 23 and a horizontally enlarged cushion 24 connected thereto.

The seat-back arrangement 14 also includes a back assembly 26 which is connected to the seat assembly 22 by a generally L-shaped rigid upright 27. The upright 27 has an upper end which supports a vertically enlarged back rest 28 thereon and a lower end which is connected to the seat housing 23.

The back assembly 26 and seat assembly 22 can be connected together in various conventional arrangements. For example, the lower end of the upright 27 may be rigidly fixed to the seat housing 23 such that the seat assembly 22 and back assembly 26 move together in unison. Alternatively, the lower end of the upright 27 may be pivotally connected to the seat housing 23 such that the back assembly 26 is vertically tiltable relative to the seat assembly 22 while the entire seat-back arrangement 14 is vertically tiltable relative to the base 12.

With respect to the tilt control mechanism 16, this mechanism connects the seat-back arrangement 14 to the base 12 to permit universal tilting or swiveling therebetween. While many conventional tilt control mechanisms define fixed pivot axes about which the seat or back are tiltable, the tilt control mechanism 16 of this invention not only permits tilting of the seat-back arrangement 14 forwardly and rearwardly, but also in any direction relative to a central upright axis defined by the base.

In particular, while the seat-back arrangement 14 is generally biased to the neutral position illustrated in FIG. 1, the tilt control mechanism 16 of the invention permits the seat assembly 22 to pivot and swivel about a pivot point so as to permit universal tilting of the seat assembly 22. Thus, the seat-back arrangement 14 reacts to movements of a user forwardly and rearwardly and also sidewardly and any direction therebetween.

The tilt control mechanism 16 (FIGS. 2–4) includes a pivot or support fitting 30 which is rigidly supported on the upper end of the spindle 20 (FIG. 1). To pivotally connect the seat assembly 22 to the spindle 20, a retainer bracket 31 is supported on the upper end of the support fitting 30 by a pivot connection defined therebetween. The retainer bracket 31 rigidly supports the seat assembly 22 thereon such that the seat assembly 22 is vertically pivotable relative to the base 12. As described herein, the pivot connection between the support fitting 30 and retainer bracket 31 effectively defines a pivot point 32 rather than a fixed pivot axis such that the seat assembly 22 is pivotable in any horizontal direction extending radially away from the pivot point.

The tilt control mechanism 16 also includes an elastomeric resilient ring 34 which resists tilting of the seat assembly 22. The resilient ring 34 is stationary and acts on the retainer bracket 31 through an adjustment sleeve or insert 35 disposed therebetween. The adjustment sleeve 35 is vertically movable to adjust the contact area between the sleeve 35 and the resilient member 34 which adjusts the effective size of the resilient ring 34 and thereby adjusts the resistance to tilting. The specific construction and function of these component parts is described in more detail hereinafter.

Figure 3:
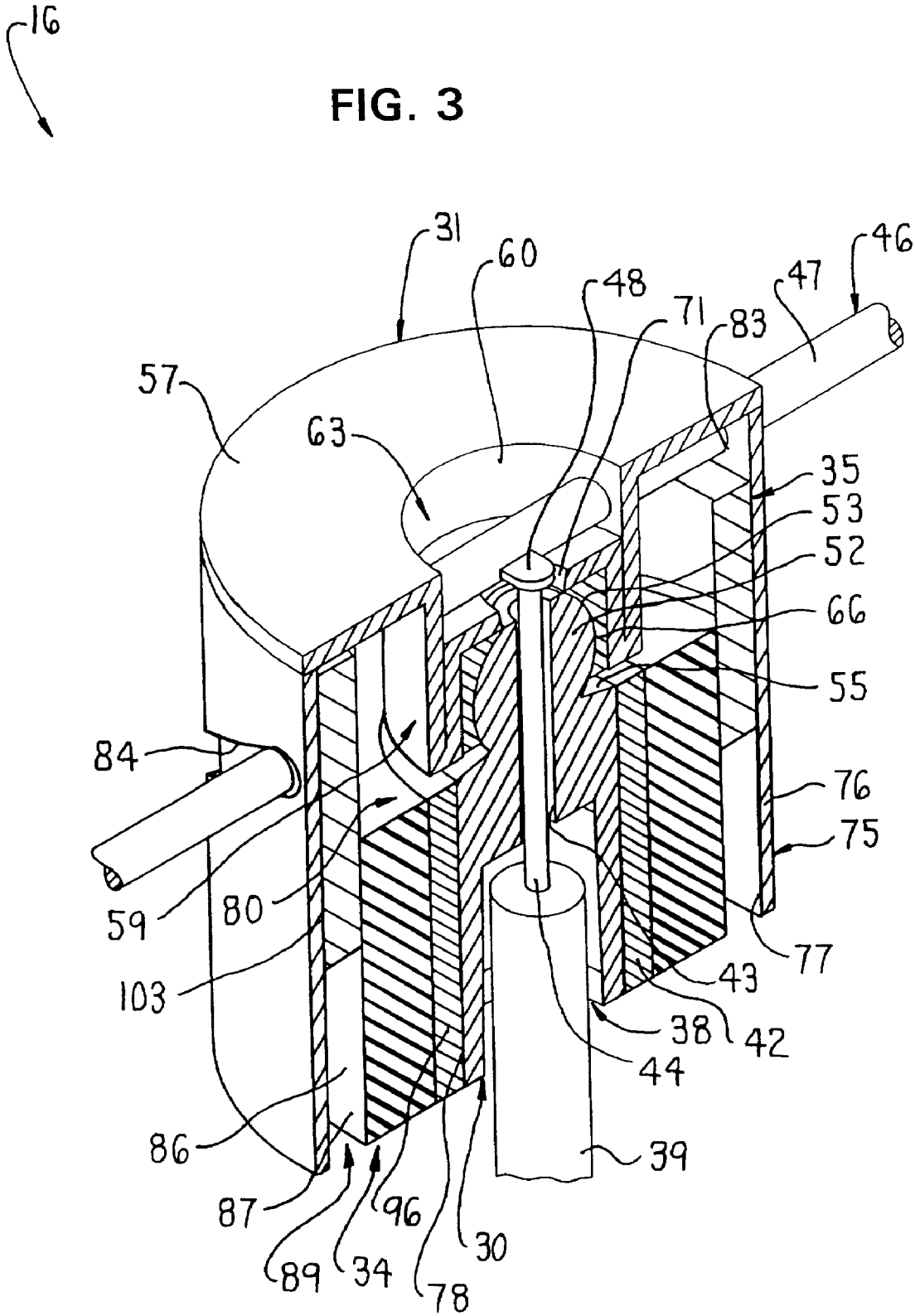
FIG. 3 is a partial perspective view in cross-section of the tilt control mechanism.
Figure 4:
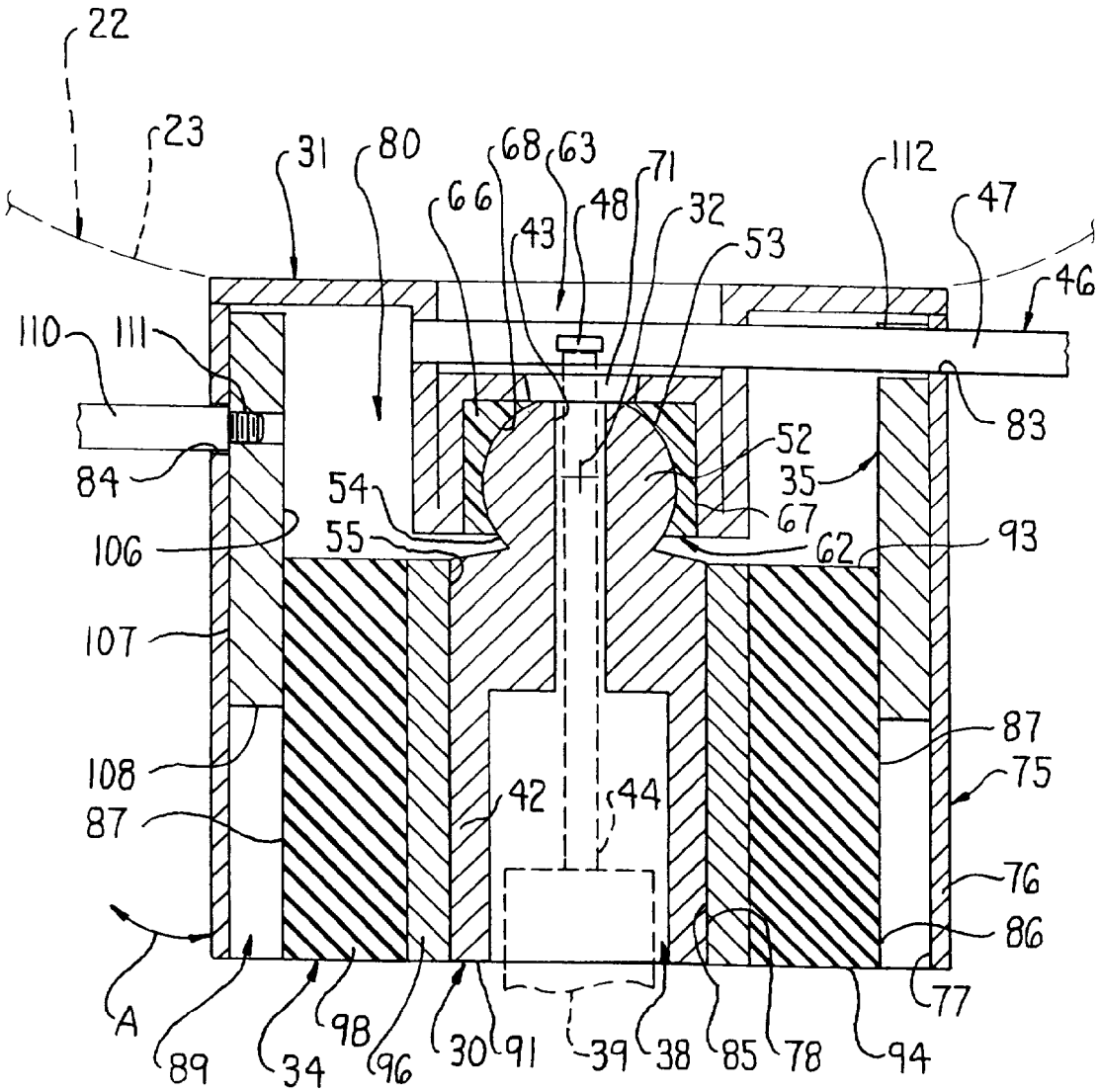
FIG. 4 is a front cross-sectional view of the tilt control mechanism illustrating a resilient ring therein and an adjustment sleeve which is vertically movable.

Referring to FIGS. 3 and 4, the support fitting or member 30 is a vertically-elongate cylindrical tube which is rigidly connected to the upper end of the spindle 20 in coaxial relation therewith such that the support fitting 30 defines a vertical extension of the spindle 20. The lower end 37 of the support fitting 30 preferably defines an interior chamber 38 which opens downwardly to receive the upper end of a pneumatic cylinder 39 (FIG. 3) therein.

The pneumatic cylinder 39 is provided in the spindle 20 when the base 12 is height adjustable. The pneumatic cylinder 39 thereby adjusts the vertical length of the spindle 20 to adjust the height of the seat assembly 22, which arrangement is conventional.

To provide access to the pneumatic cylinder 39, the interior chamber 38 of the support fitting 30 is defined by an outer wall 42 which thickens significantly at an upper end thereof to define a bore 43 that extends vertically from the interior chamber 38 to the top end of the support fitting 30 and receives an actuator rod 44 vertically therethrough. The actuator rod 44 has a lower end connected to a valve on the pneumatic cylinder 39 and an upper end which projects vertically from the top of the support fitting 30.

To move the actuator rod 44 vertically, the tilt mechanism 16 is adapted to support a height adjustment handle 46 (FIGS. 1 and 3) which acts on the actuator rod 44 to operate the pneumatic cylinder 39. The height adjustment handle 46 includes a shaft 47 which extends horizontally into the tilt mechanism 16 and has a paddle-like flange 48 on the innermost end thereof. The flange 48 is disposed directly above the actuator rod 44, and the shaft 47 is rotatable about its longitudinal axis to move the actuator rod 44 vertically by movement of the flange 48 which thereby operates the pneumatic cylinder 39 to adjust the overall height of the base 12.

To pivotally support the seat assembly 22, the support fitting or bearing 30 further includes a ball 52 on the upper end thereof. The ball 52 is formed integral with the tubular wall 42 of a rigid wear-resistant material such as steel and has a generally spherical shape. As a result, the ball 52 has an outer surface 53 which preferably defines a convex partially spherical bearing surface that primarily faces upwardly but also extends downwardly and inwardly to form an annular groove 54 and an annular upward-facing shoulder 55 near the outer wall 42. The shoulder 55 tapers slightly downwardly.

The retainer bracket 31 seats on the ball 52 to define a pivot connection therewith. Since the retainer bracket 31 is also rigidly connected to the seat assembly 22, tilting of the seat assembly 22 causes the retainer bracket 31 to pivot (i.e. swivel) relative to the support fitting 30.

More particularly, the retainer bracket 31 has a ring-like mounting flange 57 which extends generally horizontally and is rigidly connected to the housing 23 of the seat assembly 22. The flange 57 has a circular shape when viewed from above although other shapes may be provided so long as the flange 57 can be connected to or otherwise support the seat housing 23.

An inside diameter of the flange 57 is formed integral with a cylindrical collar 59 which extends downwardly. The cylindrical collar 59 includes an outer wall 60 which extends vertically, and a divider wall 61, which extends horizontally from the outer wall 60, generally midway between the top and bottom edges of the outer wall 59 as shown in FIG. 4. The collar 59 thereby defines a bushing seat 62 which is defined below the divider wall 61, and a shaft chamber 63 which is defined above the divider wall 61.

In the illustrated embodiment, the retainer bracket 31 is formed of steel plate or other rigid material which is formed into the desired shape. During forming, the plate material is folded downwardly, upwardly and inwardly to define the collar 59 and divider wall 61 such that the collar 59 has multiple layers of plate material while the divider wall 61 extends radially inwardly from the outer wall 60.

To connect the retainer bracket 31 to the support fitting 30, the bushing seat 62 receives a generally diametrically split cylindrical bushing 66 through the open bottom of the collar 59. The bushing 66 includes an outer circumferential surface 67 which is tight-fittingly received within the wall 60, and a generally spherical bearing surface 68 on the hollow interior thereof which faces downwardly. The bearing surface 68 has a concave shape which corresponds to the convex shape of the ball 52, and the bushing 66 is secured in the collar 59 of the retaining bracket 31 and is also fitted onto the ball 52 such that the opposing bearing surfaces 68 and 53 are in slidable contact with each other.

The retainer bracket 31, bushing 66 and ball 52 thereby define a pivot connection between the chair base 12 and the seat assembly 22. To reduce friction, the bushing 66 preferably is formed of acetal or equivalent similar materials.

Since the opposing bearing surfaces 53 and 68 extend circumferentially and are generally spherically curved, the pivot point 32 is defined at the center of the ball 52, about which the entire seat assembly 22 pivots or swivels. In particular, the seat assembly 22 is able to vertically pivot in any horizontal direction that extends radially outwardly from the pivot point 32 and can also be swiveled about the connection point. This universal tilting of the seat assembly 22 thereby allows the seat assembly 22 to tilt and, in effect, to react to movements by the chair occupant whether forwardly, rearwardly, sidewardly, or any direction therebetween.

To assist in securing the bushing 66 to the ball 52, the bearing surface 68 of the bushing 66 preferably converges radially inwardly into the groove 54 formed on the ball 52. While the resilient ring 34 resists and limits the universal tilting as described herein, the bushing 66 and outer wall 60 also may swing downwardly and contact the shoulder 55 if tilting of the seat assembly 22 is excessive. The shoulder 55 thereby defines a positive stop which in this embodiment is annular to provide a symmetrical stop that limits tilting equally in all directions. Alternatively, an asymmetric positive stop may also be provided.

In the preferred embodiment, the opening 71 has a sufficiently large diameter so as to avoid contact with the actuator rod 44. To achieve this result, the opening 71 preferably has a circular shape when viewed from above and tapers upwardly outwardly when viewed from the side (FIG. 4). However, the opening 71 may also be permitted to contact the actuator rod 44 to limit tilting and thereby act as a positive stop. If the opening 71 is circular as illustrated, the stop arrangement would be symmetric.

To provide an asymmetric stop arrangement, the opening 71 may have an asymmetric shape such as an ellipse. More specifically, the major axis would extend in a forward and rearward direction to limit forward and rearward tilting to a first angle (such as 12 degrees), while the minor axis would extend sidewardly to limit sideward tilting to a second angle (such as 8 degrees) which is smaller than the first angle. Tilting which is between forward and sideward tilting would thereby be limited to an intermediate angle which varies between the first and second angles.

Still further, the opening 71 could have other asymmetric shapes to vary the tilt angles. For example, the opening 71 could be egg-shaped wherein forward tilting would be limited to a greater extent than rearward tilting.

Figure 5:
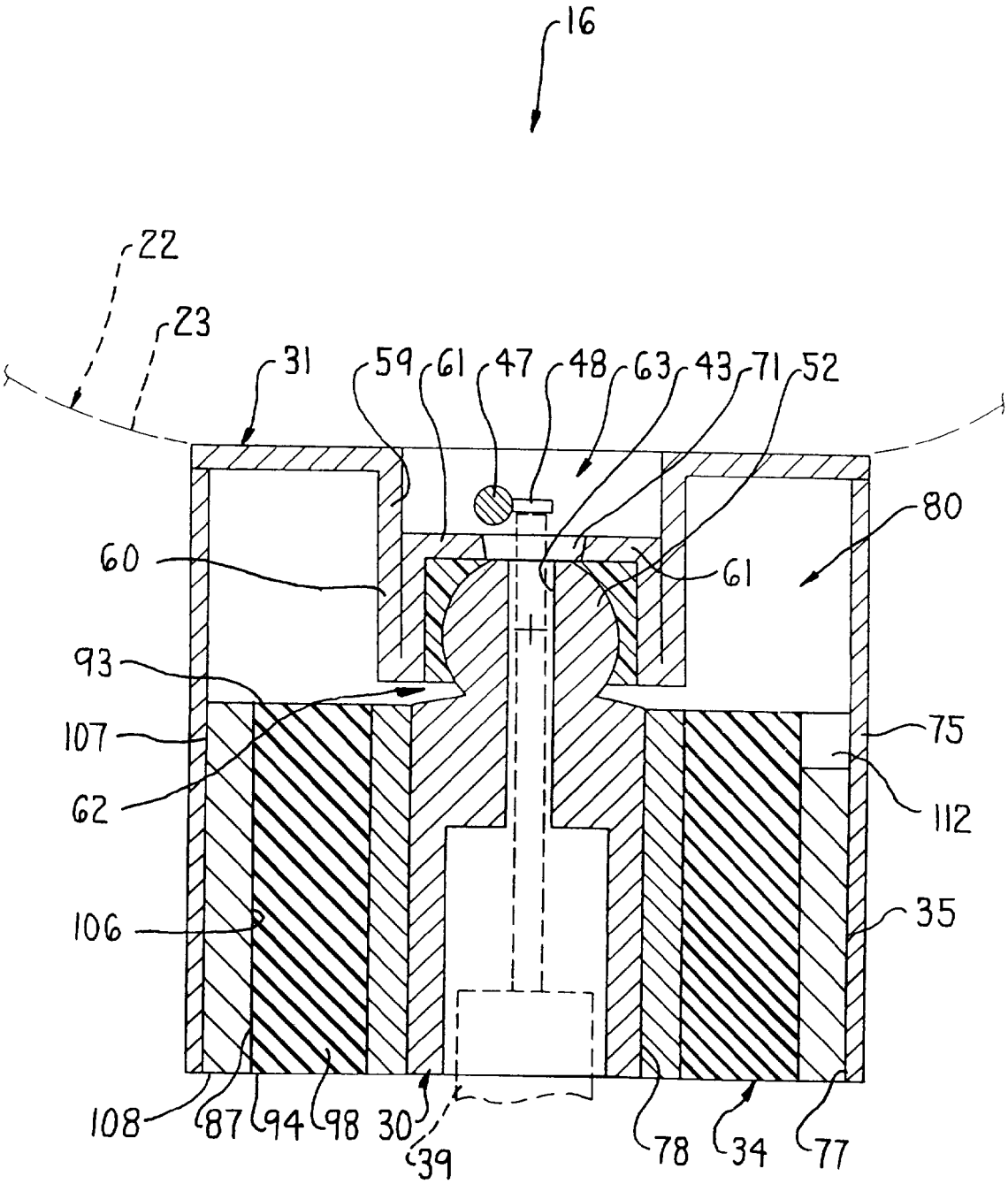
FIG. 5 is a side view of the tilt control mechanism in cross-section illustrating the adjustment sleeve after downward vertical movement thereof.

To adjust the chair height, the retainer bracket 31 also supports the height adjustment handle 46 thereon. In particular, the handle shaft 47 is rotatably supported by opposite sides of the outer collar wall 60 and extends radially inwardly into the shaft chamber 63. As shown in FIGS. 3 and 5, the shaft 47 is offset from the center of the collar wall 60 such that the flange 48 is disposed above the opening 71 formed through the center of the divider wall 61. As illustrated in FIG. 5, the actuator rod 44 extends vertically through this opening 71 as seen in phantom outline such that rotation of the shaft 47 causes the flange 48 to drive the actuator rod 44 downwardly and actuate the pneumatic cylinder 39.

The retainer bracket 31 also supports a cylindrical housing 75 near the outer diameter of the mounting flange 57.

The housing 75 is rigidly secured at the upper end thereof to the mounting flange 57, and includes an outer wall 76 having an interior surface 77 which is disposed coaxial and concentric with an outer surface 78 of the support fitting 30 when the seat-back is in its normal upright or neutral position.

The interior surface 77 and the outer surface 78 preferably are disposed in spaced apart relation such that an annular clearance space 80 is defined radially therebetween. The clearance space 80 extends vertically between the top and bottom of the housing 75. When the seat assembly 22 is in the neutral position (FIG. 1), the opposing surfaces 77 and 78 preferably are parallel to each other such that the clearance space 80 has a uniform radial width along its vertical length.

To support the height adjustment handle 46, the outer housing wall 76 includes a bore 83 which rotatably supports the handle shaft 47. The housing wall 76 also includes an inclined elongate slot 84 on the side opposite the bore 83 which slot 84 is provided for vertical movement of the adjustment sleeve 35 as described herein.

Figure 2:
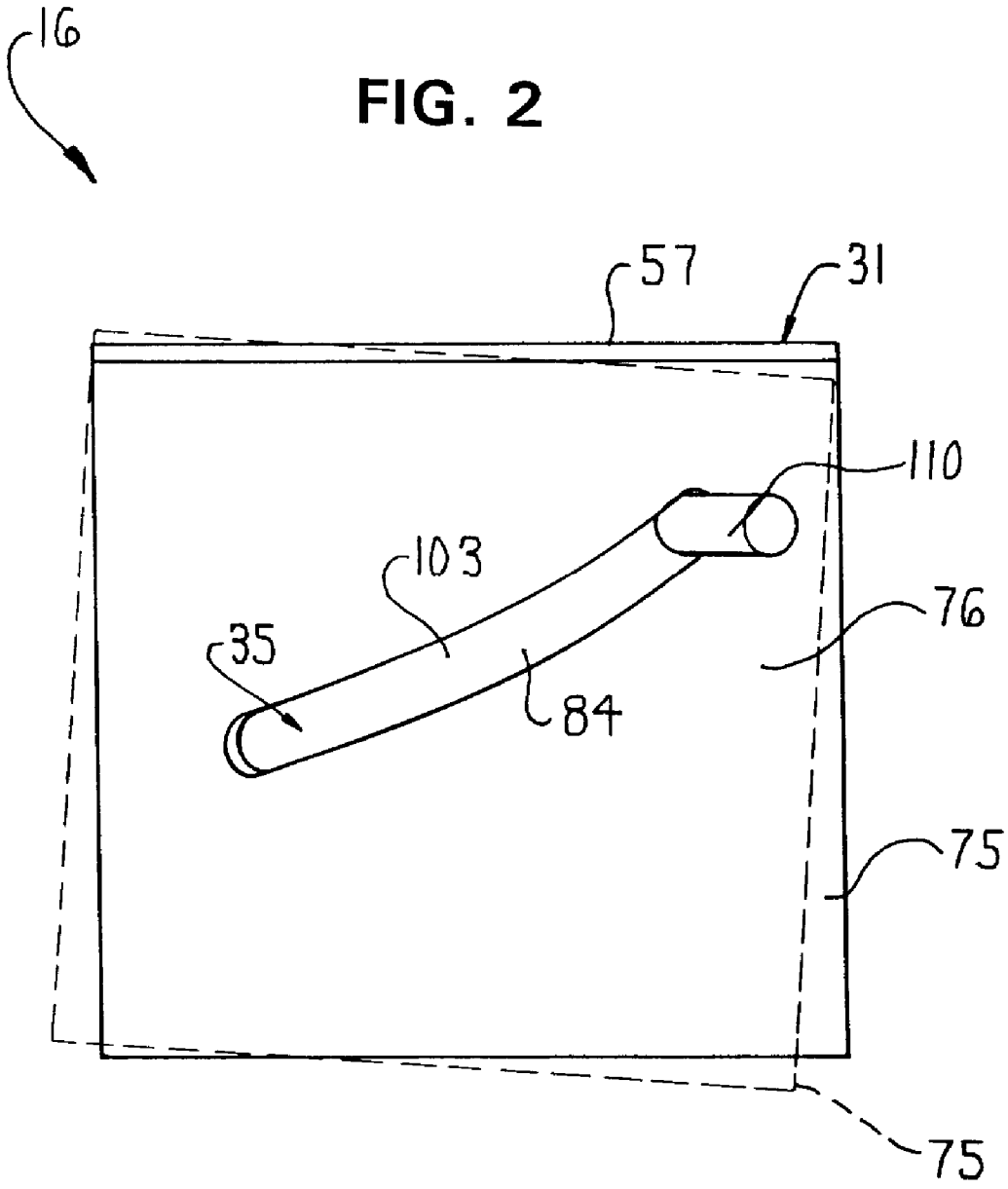
FIG. 2 is an enlarged side elevational view of the tilt control mechanism of the chair.

Since the housing 75 is connected to the retainer bracket 31, the housing 75 moves with the seat assembly 22 during tilting thereof. During tilting, the lower edge of the housing 75 on one side thereof moves toward the support fitting 30 as generally shown in FIG. 2 in phantom outline, and relative movement occurs between the opposing surfaces 77 and 78 (as generally indicated by reference arrow A in FIG. 4).

To control tilting, the resilient ring 34 is provided in the clearance space 80. In particular, the resilient ring 34 has an annular shape which fits into the clearance space 80 in concentric relation with the support fitting 30 and the housing 75.

The resilient ring 34 has a radial width defined between an inner diameter 85 and an outer diameter 86. The inner diameter 85 is fitted onto the outer surface 78 of the support fitting 30 such that the resilient ring 34 is stationary during use. The outer diameter 86 defines a circumferential contact surface 87 which faces radially outwardly in opposing relation to the interior surface 77 of the housing 75. The radial width of the resilient ring 34 is proximate but less than the radial width of the clearance space 80 such that a radial space 89 is defined between the contact surface 87 of the resilient ring 34 and the opposing interior surface 78 of the housing 75. This radial space 89 slidably receives the adjustment sleeve 35 as discussed in more detail hereinafter such that the tilting of the housing 75 causes the adjustment sleeve 35 to press against the contact surface 87 and cause deflection of the resilient ring 34.

The axial thickness of the resilient ring 34 extends generally along the axial length of the support fitting 30 and more particularly, between the shoulder 55 on the upper end thereof and a lower edge 91 (FIG. 4) on an opposite end of the support fitting 30. The axial thickness of the resilient ring 34 defines upper and lower edges 93 and 94 of the contact surface 87. The upper and lower edges 93 and 94 thereby define a fixed axial distance for the contact surface 87 along which the adjustment sleeve 35 can slide.

Preferably, the resilient ring 34 includes an inner band 96 which defines the inner diameter 85 of the ring 34 and is stationarily secured on the support fitting 30. The inner band 96 is formed of a rigid material such as metal although other suitable materials may be used and the band 96 could even be eliminated.

The inner band 96 includes an elastomeric material 98 which extends radially outwardly therefrom and is resiliently deflectable to permit relative movement between the inner and outer diameters 85 and 86 during tilting. The material 98 is preferably bonded or adhesively secured to the band 96. Any suitable resilient and durable material may be used, and in the preferred embodiment, the elastic material 88 is a natural rubber of 40–60 durometers.

During tilting of the chair 10, the housing 75 and adjustment sleeve 35 move relative to the support fitting 30 which thereby presses the adjustment sleeve 35 against the contact surface 87 and compresses the resilient material 98 on one side of the support fitting 30. This compression serves to resist tilting of the seat assembly 22 and, in particular, generates a force acting on the housing 75 which increases as the angle of tilt increases. When the load on the seat assembly 22 is released, the resilient ring 34 biases the housing 75 and restores the seat assembly 22 to the neutral position.

While the housing 75 is disposed radially outwardly of the resilient ring 34, this arrangement may be modified, for example, by positioning the resilient ring 34 about the exterior of the housing 75 and providing a further annular housing which is fixed to the base 12 and is disposed radially outwardly of the resilient ring. In this modified arrangement, the resilient ring would still be positioned between a fixed surface and a movable surface which moves in response to tilting of the seat assembly. As a result, the resilient ring resists tilting and biases the seat to the neutral upright position.

With respect to the illustrated embodiment, the tilt control mechanism 16 also permits adjustment of the tilting resistance. In particular, the aforementioned adjustment sleeve 35 not only is compressed between the resilient ring 34 and the housing 75 but also is vertically movable to adjust the characteristics of the resilient ring 34.

More particularly, the adjustment sleeve 35 has a cylindrical shape which fits within the hollow interior of the retainer bracket 31 as seen in FIGS. 3 and 4. In particular, the adjustment sleeve 35 is both rotatable about the central axis of the collar 59 and is movable vertically in the clearance space 80.

The sleeve 35 projects downwardly and defines an insert section which is insertable into the radial space 89 such that the adjustment sleeve 35 is insertable between or intermediate the resilient ring 34 and the housing 75. The sleeve 35 includes an interior surface 106 which is disposed in opposing and contacting relation with the contact surface 87 of the resilient ring 34, and an outer circumferential surface 107 which is disposed in opposing and contacting relation with the interior surface 78 of the housing 75. The sleeve 35 contacts these opposing surfaces such that movement of the housing 75 causes the sleeve 35 to press against the contact surface 87 and deflect the resilient ring 34 radially inwardly. The resilient ring 34, however, resists such deflection so as to oppose tilting of the seat assembly 22.

The amount of tilting resistance is defined by the overall area of contact between the interior sleeve surface 106 and the contact surface 87. As seen in FIG. 4, the contact area extends vertically between the upper edge 93 of the resilient ring 34 and a lower edge 108 of the sleeve 35. Thus, while the contact surface 87 has a fixed area extending vertically between the upper and lower edges 93 and 94 thereof, the tilting moment applied to the resilient ring 34 by the housing 75 acts on a portion of this contact surface 87, or more particularly, on the contact area which extends between the edges 93 and 107. At the upper end of its stroke (FIG. 4) the sleeve 35 is disposed near the mounting flange 57.

As seen in FIG. 5, however, displacement of the adjustment sleeve 35 downwardly increases the distance between the edges 93 and 107 so as to increase the contact area on which the tilting moment acts on the resilient ring. At the lower end of its stroke (FIG. 5), the sleeve 35 contacts substantially the entire height of the contact surface 87. Since the contact area increases during downward movement of the sleeve 35, the effective vertical dimension of the resilient ring 34 which resists tilting is increased such that the spring force increases as the contact area increases and thus a greater tilting moment needs to be applied to the seat assembly 22 to be able to tilt the seat assembly 22 to the same degree.

While the resilient ring 35 is illustrated in one position in FIG. 4 and a further position in FIG. 5, the contact area is continuously variable and may be set at any magnitude depending upon the relative distance between the edges 93 and 101. Thus, the contact area may be varied to vary the effective size of the resilient ring 34 or in other words, the portion of the resilient ring 34 on which the tilting moment effectively acts through its contact with the sleeve 35. This arrangement, thereby provides a ring 34 having a fixed thickness and width wherein the effective resilient or spring characteristics of the ring 35 are selectively varied by a user.

To effect vertical movement of the sleeve 35, the sleeve 35 is connected to an adjustment handle 110 (FIGS. 2–4) which extends outwardly therefrom. The adjustment handle 110 extends through the inclined slot 84 in the housing 75 as seen in FIG. 2, and has an inner end 111 which is threaded into the sleeve 35 as seen in FIG. 4.

The outer end of the adjustment handle 110 is grasped manually by an occupant and pulled or swung sidewardly which causes the sleeve 35 to rotate about the collar 59. Since the handle 110 is confined in the inclined slot 84, the handle 110 moves vertically, either downwardly or upwardly, depending on the direction of rotation of the sleeve 35 which causes the adjustment sleeve 35 to also move vertically. Thus, the occupant can adjust the position of the adjustment sleeve 35 and as a result, adjust the contact area at the interface between the sleeve 35 and ring 34.

The sleeve 35 also includes a notch 112 on the upper edge thereof which receives the handle 47 therein when the sleeve 35 is at the upper end of its vertical stroke as seen in FIG. 4.

With the above-described arrangement, the chair 10 not only provides universal tilting but the tilting resistance is adjustable to accommodate different size users or to provide different tilting characteristics.

In operation, the seat assembly 22 is tiltable about the pivot point 32 in any direction extending radially away from the pivot point. As the seat assembly 22 tilts, the housing 75 moves relative to the support fitting 30 which thereby compresses the resilient ring 34 on one side thereof. This compression of the resilient ring 34 generates a resistance force which is applied to the housing 75 through the adjustment sleeve 35 disposed therebetween. Once tilting is completed, the resiliency of the ring 34 causes the seat assembly 22 to return to its neutral position.

Since resistance to tilting may need to be adjusted depending upon the characteristics and requirements of an occupant, the occupant can selectively rotate the adjustment sleeve 35 by swinging the handle 110. The handle 110 slides down or up the inclined slot 84 to move the adjustment sleeve 35 and adjust the tilting resistance provided by the resilient ring 35.

FIGS. 6–9 illustrate a second embodiment for the tilt control mechanism 16-1. The second embodiment incorporates a number of common components as described herein, which common components are designated by the same reference numeral in combination with "–1". These common components have similar structures or functions to those described above, and the following disclosure is directed primarily to the differences therebetween. Generally with respect to this embodiment, tilting resistance is adjusted by movement of an adjustment housing 35-1 sidewardly relative to a resilient member 34-1 rather than vertically.

More particularly, the tilt control mechanism 16-1 includes a support fitting 30-1 which is supported on a chair base, and a cylindrical outer wall 42-1 to which a ball 52-1 is attached. The ball 52-1 defines a convex bearing surface 53-1 which faces upwardly. A central bore 43-1 and a bracket opening 71-1 also are provided to accommodate an actuator rod 44-1 therethrough and permit actuation of a pneumatic cylinder 39-1 as provided in a height-adjustable base.

The seat assembly 22-1 is pivotally connected to the support fitting 30-1 by a retainer bracket 31-1. The retainer bracket 31-1 includes a split bushing 66-1 at the center thereof. The bushing 66-1 defines a concave bearing surface 68-1 which cooperates with the bearing surface 53-1 to define a pivot connection therebetween.

The retainer bracket 31-1 is defined at the top thereof by a mounting flange 57-1 on which a seat assembly 22-1 is rigidly supported. The mounting flange 57-1 extends radially outwardly and is bent downwardly at the outer diameter thereof to define a support flange 125. The support flange 125 may be formed as separate circumferentially spaced apart tabs as will be appreciated from the discussion herein although the support flange 125 preferably extends about the circumference of the mounting flange 57-1. The support flange 125 includes a plurality of circumferentially spaced apart fastener bores 126 which extend horizontally therethrough.

Figure 6:
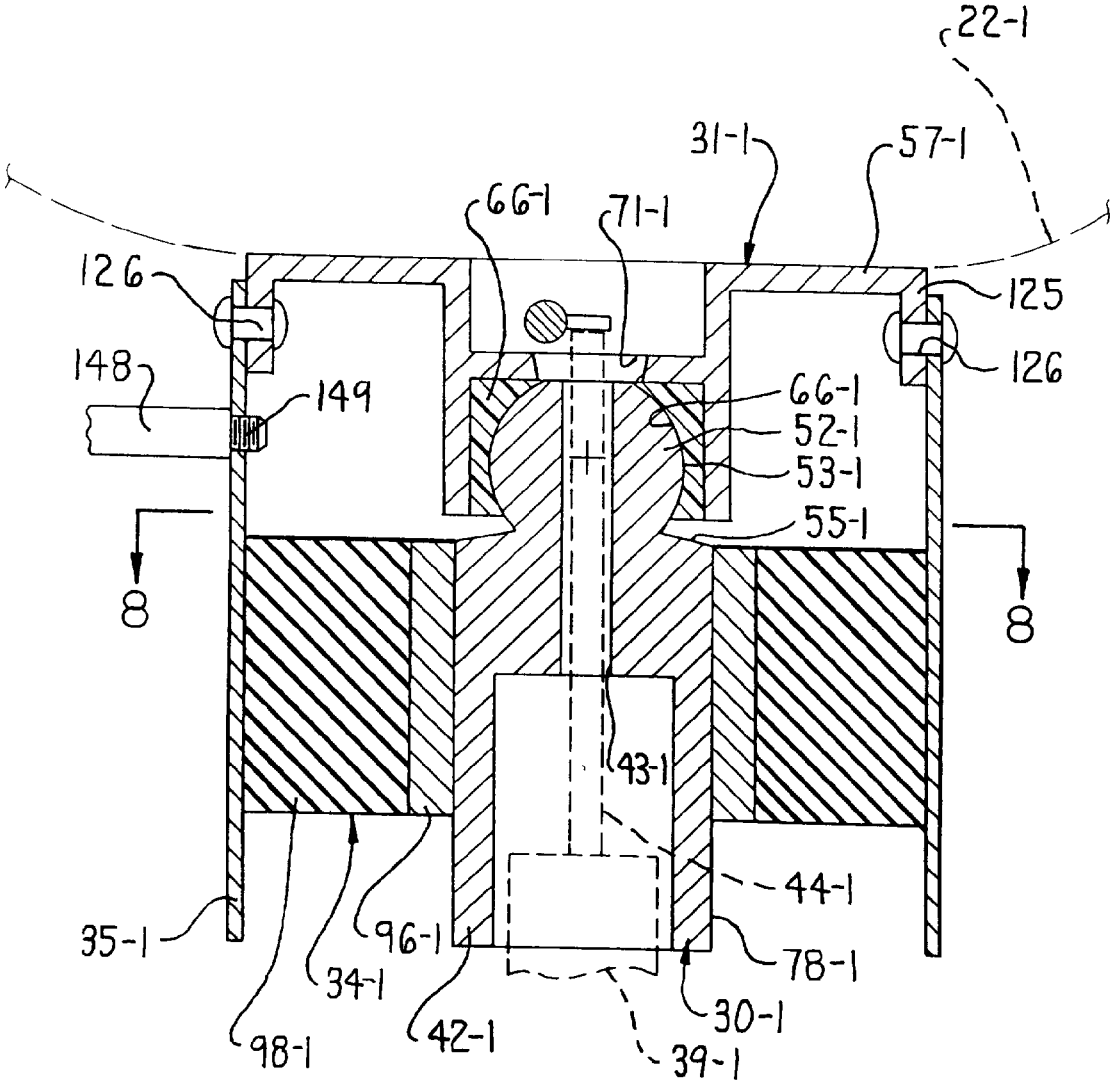
FIG. 6 is a front elevational view of a second embodiment of the tilt control mechanism having a rotatable adjustment housing.
Figure 7:
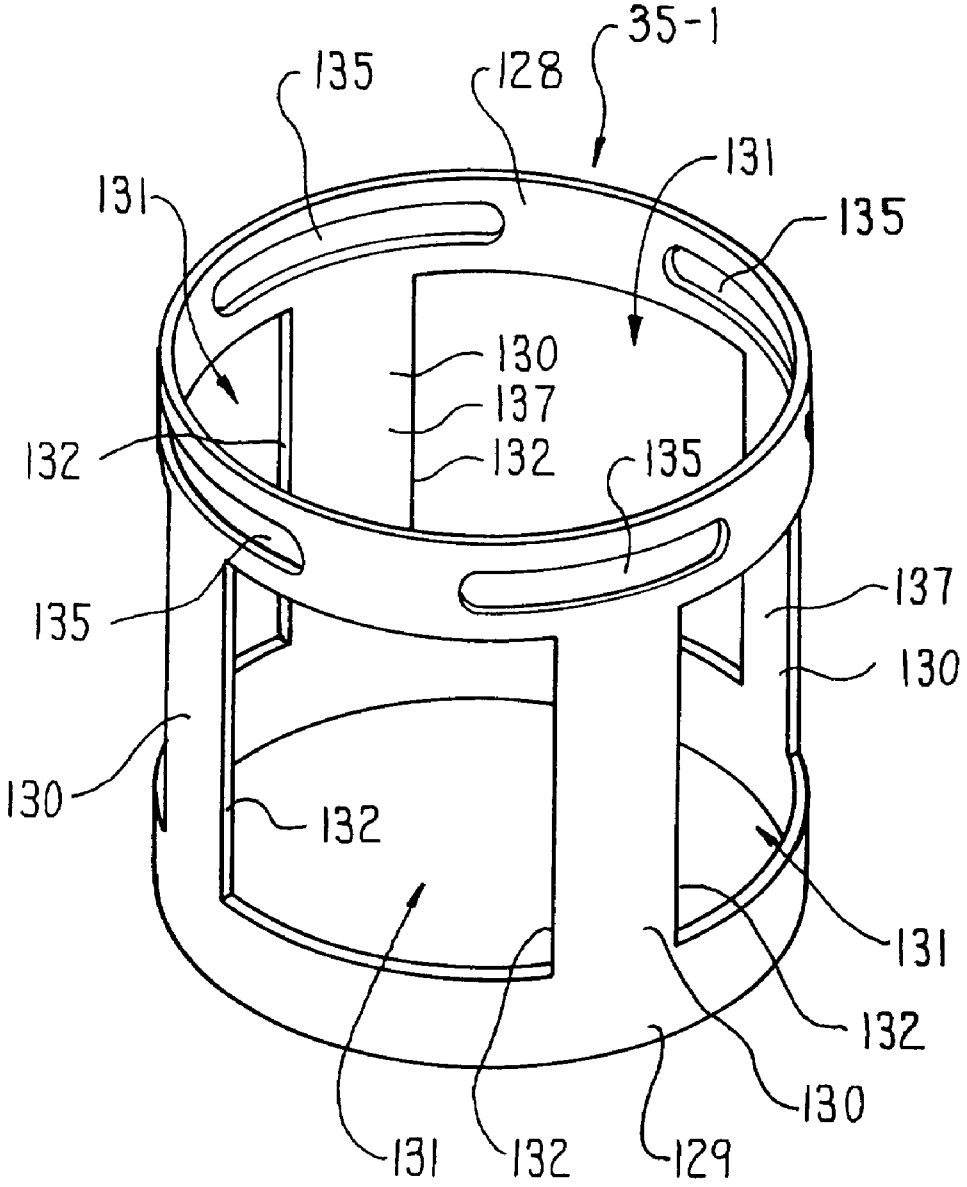
FIG. 7 is a perspective view of the rotatable adjustment housing of FIG. 6.

Referring to FIGS. 6 and 7, the retainer bracket 31-1 supports a cylindrical adjustment housing 35-1 which projects downwardly therefrom in concentric relation with the support fitting 30-1. Similar to the embodiment of FIGS. 1–5, the adjustment housing 35-1 moves relative to the support fitting 30-1 and compresses a resilient ring-like member 34-1 therebetween during tilting of the seat assembly 22-1.

The adjustment housing 35-1 has a generally cylindrical shape in that the upper and lower ends are defined by upper and lower housing sections 128 and 129 (FIG. 7) which are circular when viewed from above and are vertically spaced apart. The upper and lower housing sections 128 and 129 are joined vertically together by vertical elongate lands or lobes 130 which extend vertically between the upper and lower housing sections 128 and 129 and are circumferentially spaced apart from each other to define windows 131 therebetween. Each land 130 has a circumferential dimension or width defined between opposite vertical side edges 132 thereof. The adjustment housing 35-1 is rotatably connected to the support flange 125 as described herein.

In particular, the upper housing section 128 includes a plurality of horizontally elongate slots 135 which are circumferentially spaced apart from each other and disposed vertically above the lands 130. The slots 135 are adapted to align with the corresponding fastener bores 126 as seen in FIG. 6. The adjustment housing 35-1 is rotatably connected to the support flange 125 by a fastener 136 which extends through each aligned slot 135 and fastener bore 126 corresponding thereto. The fasteners 136 permit rotatable movement of the adjustment housing 35-1 about a central vertical axis which extends centrally through the tilt control mechanism 16-1.

The adjustment housing 35-1 is disposed radially outwardly of the resilient ring 34-1 and includes interior surfaces 137 on each of the lands 130 which contract the resilient ring as will be discussed herein. The adjustment housing 35-1 is thereby rigidly connected to the support flange 125 and moves with the retainer bracket 31-1 during tilting of the seat assembly.

To resist movement of the adjustment housing 35-1 and thereby resist tilting of the seat assembly 22, the resilient ring 34-1 is positioned between the support fitting 30-1 and the adjustment housing 35-1. The resilient ring 34-1 includes an annular inner band 96-1 which is stationarily positioned on the outer surface 78-1 of the support fitting 30-1. The inner band 96-1 has an annular shape.

The resilient ring 34-1 further includes a resilient elastomeric material 98-1 which extends radially outwardly of the inner band 96-1. However, the elastomeric material 98-1 defines a plurality of circumferentially spaced apart pads 140 which project outwardly. The resilient ring 34-1 also defines a circumferentially elongate clearance space 145 between each pair of pads 140.

Figure 9:
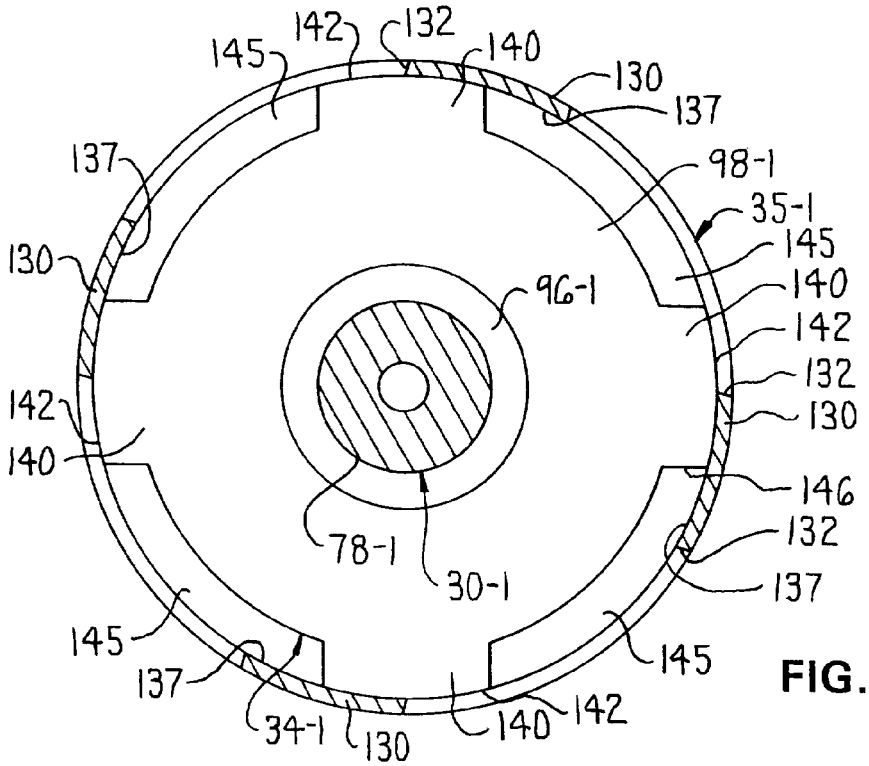
FIG. 9 is a diagrammatic plan view in cross-section illustrating the adjustment housing in a rotated position.

Each of the pads 140 projects radially and defines a radially outward facing contact surface 142 which is disposed in slidable contact with a corresponding land 130 as seen in FIG. 9. Therefore, the interior surface 137 of each land 130 defines an interface with a corresponding contact surface 142 wherein the interior surface 137 and corresponding contact surface 142 are disposed in opposing and contacting but slidable relation. As a result, tilting of the seat assembly 22 causes the adjustment housing 35-1 to move relative to the support fitting 30-1 such that the lands 130 act on or press against the corresponding contact surface 142. The resilient ring 34-1 is deflectable so as to permit tilting of the seat assembly 22 while opposing this tilting as the resilient ring 34-1 deflects.

The interface between each contact surface 142 on the resilient ring 34-1 and the opposing interior surface 137 on the land 130 are in contact and thereby define a contact area through which the tilting moment of the seat assembly 22 acts. Similar to the first embodiment of FIGS. 1–5, this contact area is adjustable so as to vary the spring characteristics of the resilient ring 34-1.

Figure 8:
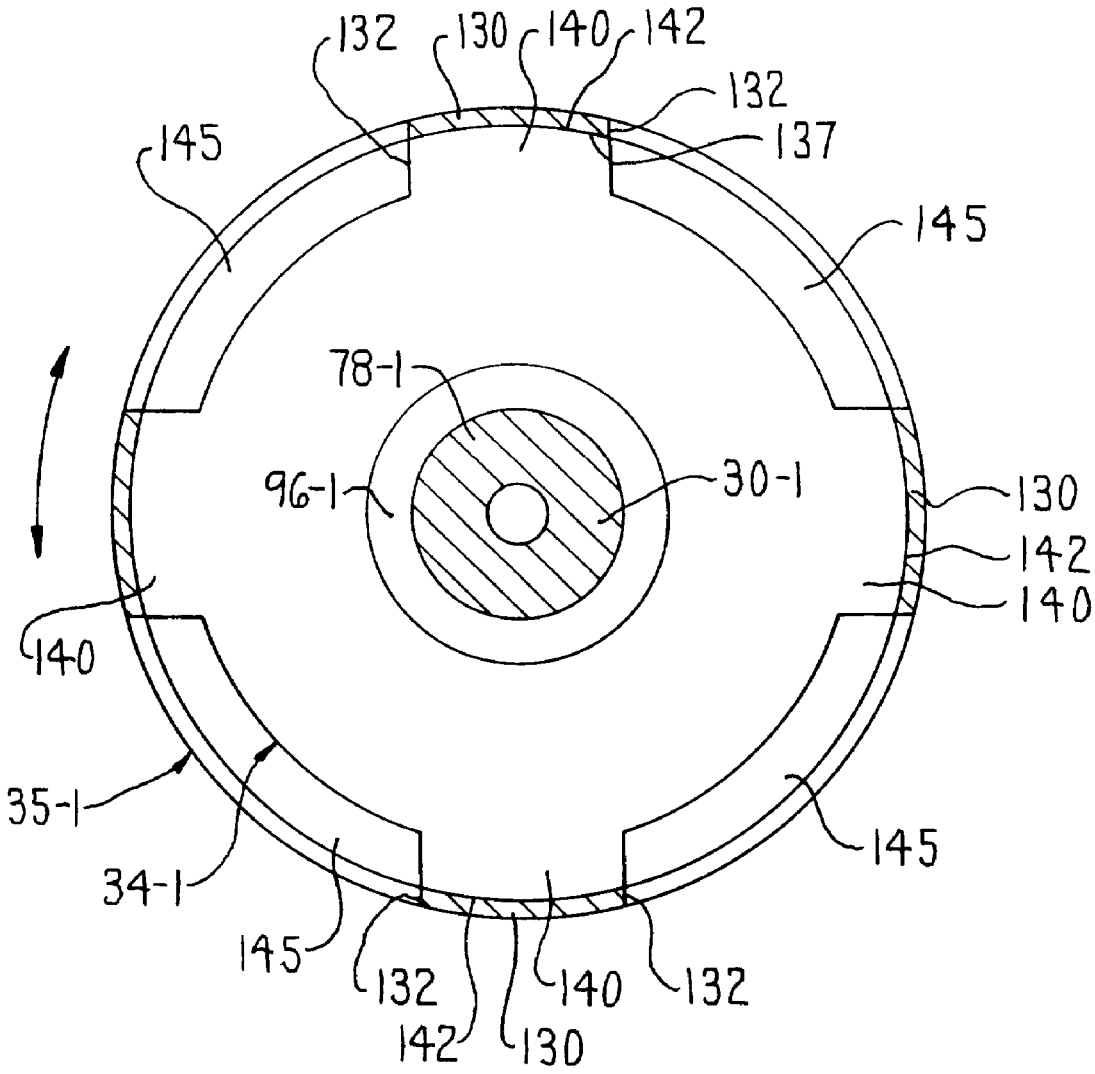
FIG. 8 is a diagrammatic plan view of the embodiment of FIG. 6 in cross-section as taken along line 8—8 in FIG. 6.

More particularly, the contact area is adjusted by rotating the adjustment housing 35-1 relative to the pads 140 on the resilient ring 34-1. FIG. 8 illustrates one position for the adjustment housing 35-1 wherein the entire interior surface 137 between the side edges 132 of each land 130 is disposed in contact with substantially the entire contact surface 142 defined by a corresponding resilient pad 140. The contact surface thereby is defined vertically along substantially the entire thickness of the resilient ring 34-1 and circumferentially between the side edges 132 of the lands 130 and vertical side edges 146 of the pads 140. When the adjustment housing 35-1 is positioned as illustrated in FIG. 8, a maximum tilting resistance is provided by the resilient ring 34-1.

The tilting resistance, however, is adjusted by rotation of the adjustment housing relative to the resilient ring 34-1. As seen in FIG. 9, the adjustment housing 35-1 can be rotated horizontally such that only a portion of the interior land surface 137 is disposed in contact with the opposing contact surface 142 on the pad 140. Due to the clearance space 145, a portion of each land 130 is disposed adjacent a corresponding clearance space 145 and thus is free of contact with the contact surface 142. As a result, the effective contact area is defined circumferentially between one side edge 132 of the land 130 and one of the side edges 146 of the pad 140. Thus, the contact area can be adjusted by horizontal movement of the adjustment housing 35-1.

To effect rotation of the adjustment housing 35-1, an adjustment handle 148 is provided which includes a threaded inner end 149 which is threadedly engaged into the upper housing section 128. The adjustment handle 148 projects radially outwardly therefrom and may be manually actuated by a user.

It will be appreciated that while a combination of four lands 130 and pads 140 are provided, any suitable number of pads and lands may be provided at any suitable circumferential spacing.

Figure 11:
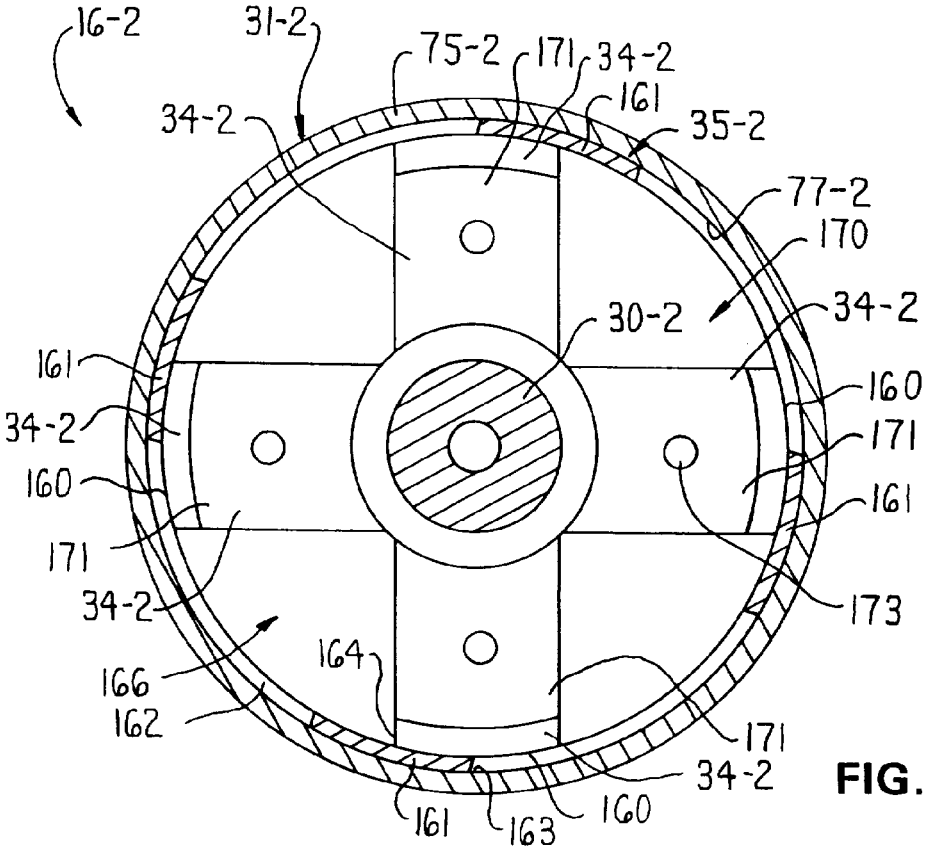
FIG. 11 is a diagrammatic plan view in cross-section illustrating the adjustment sleeve in a rotated position.
Figure 10:
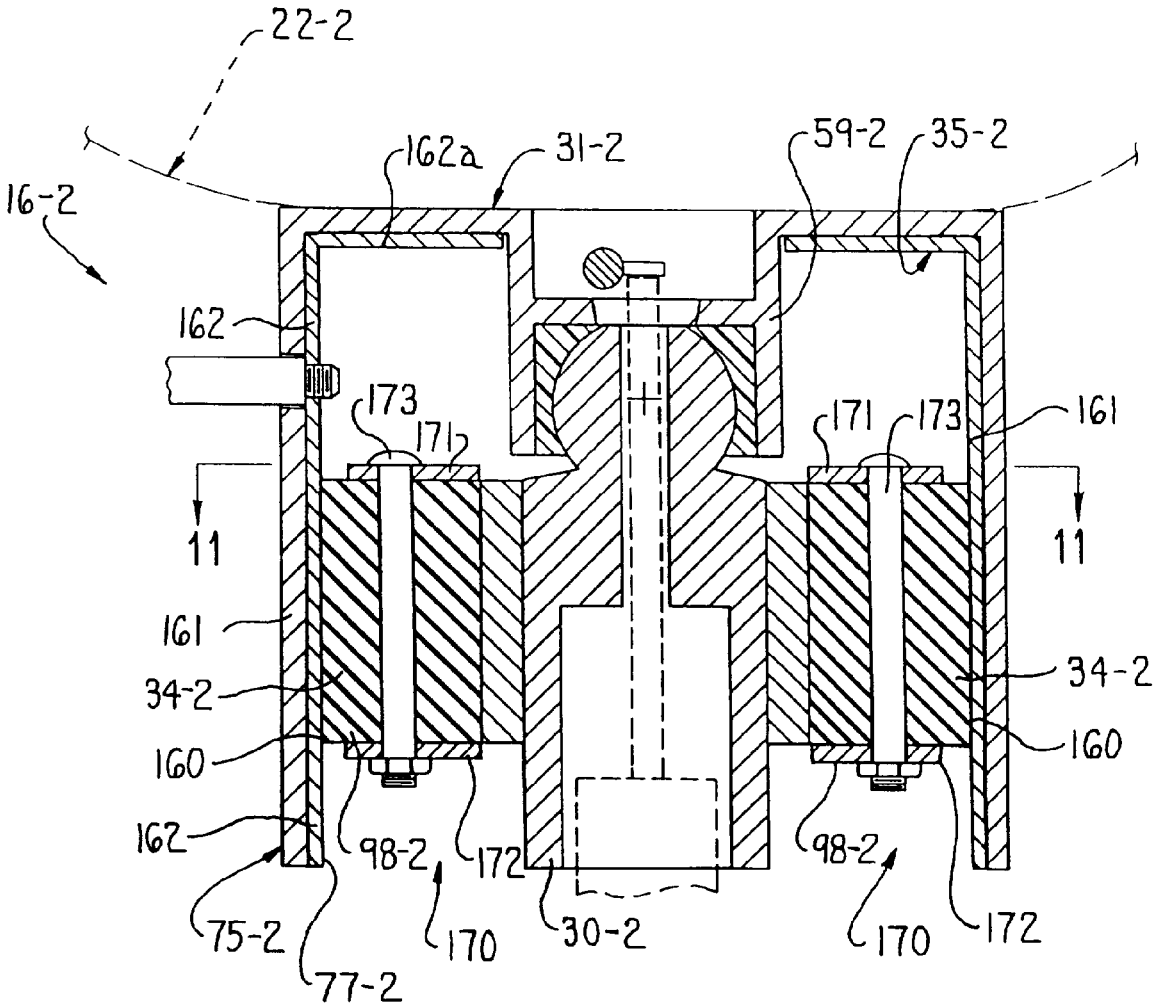
FIG. 10 is a front cross-sectional view of a third embodiment for the tilt control mechanism illustrating a rotatable adjustment sleeve and an outer housing.

A third embodiment of the invention is illustrated in FIGS. 10 and 11. In this third embodiment, the tilt control mechanism 16-2 includes a retainer bracket 31-2 and in particular, an outer housing 75-2 which is formed substantially the same as the retainer bracket 31 and housing 75 of the first embodiment of FIGS. 1–5. This outer housing 75-2 thereby defines an interior surface 77-2 which is radially spaced from a support fitting 30-2.

In this further embodiment, however, the resilient means preferably is formed as a plurality, here four, separate and circumferentially spaced apart elastomeric blocks 34-2 which extend radially between the support fitting 30-2 and the movable housing 75-2 so as to resist tilting movement of the seat assembly 22-2. Each block 34-2 defines an outward facing contact surface 160 which acts on the movable housing 75-2 through an adjustment sleeve 35-2.

In this third embodiment, the adjustment sleeve 35-2 has substantially the same shape as the adjustment housing 35-1 in FIG. 7. In particular, the adjustment sleeve includes a plurality of lands or lobes 161 which are joined together by upper and lower annular sections 162 and are disposed in a space between the contact surface 160 and the opposing interior surface 77-2 of the housing 75-2. The upper section 162, however, extends radially inwardly to define a top wall **162*a* which has a central bore and rotates about the collar 59-2 wherein rotation of the adjustment sleeve 35-2** is permitted.

The lands 161 define a contact area between a vertical side edge 163 of the land and a vertical side edge 164 of the resilient block 34-2 wherein the magnitude of the resilient spring force acting on the housing 75-2 is a function of the contact area therebetween. The adjustment sleeve 35-2 functions the same as the adjustment housing 35-1 in that the adjustment sleeve 35-2 is rotatable relative to the resilient blocks 34-2 so as to adjust the contact area defined between the lands 161 and the elastomeric pads 34-2. Since the elastomeric pads 34-2 are circumferentially spaced apart so as to define a clearance space 166 therebetween, a portion of each land 161 is disposed next to the clearance space 166 such that the tilting moment acts only through the contact area.

This third embodiment, therefore, is similar to the first embodiment in that a movable sleeve is provided between a resilient member and a movable housing while also being similar to the second embodiment in that the movable sleeve is formed so that it is rotatable and movable horizontally between the resilient members and the movable housing.

This third embodiment furthermore includes an adjustment arrangement for pre-loading each of the resilient blocks 34-2. In particular, as seen in FIG. 10, the adjustment arrangement 170 includes upper and lower plates 171 and 172 respectively wherein the elastic material 98-2 of the elastomeric blocks 34-2 is disposed vertically therebetween. A vertical adjustment member 173 such as a nut and bolt arrangement extends vertically between the upper and lower plates 171 and 172 so as to move the upper and lower plates 171 and 172 relative to each other to increase compression of the elastic material 98-2 therebetween. Preferably, each resilient block 34-2 includes a pair of upper and lower plates 171 and 172 so that the adjustment member 173 can be adjusted to compress and pre-load the resilient blocks 34-2 individually.

With this arrangement, a resilient block 34-2 located at the front of the chair 10 can be pre-loaded to a different extent than the resilient block 34-2 located at the rear of the chair. Further, the blocks 34-2 located at the sides of the chair may also be pre-loaded independently of the front and rear blocks 34-2. By allowing individual pre-loading of the blocks 34-2, a greater pre-load will resist tilting to a greater extent. Such pre-loading could be done at a factory prior to shipment to a user.

While the blocks 34-2 are independently adjustable, a single upper plate 171 and a single lower plate 172 may be provided which have an annular shape and thus extend around and compress all of the blocks 34-2 therebetween. By providing annular upper and lower plates 171 and 172, the blocks 34-2 may be provided with the same pre-load.

In the embodiments of FIGS. 2, 9 and 11, the adjustment housing or sleeve is movable vertically or horizontally to adjust the contact area with the resilient member or members. However, the resilient members may instead be connected to an adjustment mechanism so as to be moved sidewardly or vertically while the adjustment housing or sleeve remains stationary during adjustment of the contact area.

Also, in the above-described first embodiment, the resilient ring 34 is annular so as to act circumferentially around the support fitting 30. This annular shape is preferred since the resilient ring 34 provides a uniform resistance to universal tilting of the seat assembly 22.

In particular, the continuous ring provides for better transmission and generation of forces since the stretching and compressing of the material can be more readily transferred circularly around the entire ring, and this also leads to better durability. Also, the circular ring reacts the same irrespective of the plane of vertical tilt and thus provides good and uniform tilt resistance whether tilt is to front, back, side, or any angle therebetween.

Further, any of the resilient members 34, 34-1 and 34-2 may include a thin flexible outer layer or plate which defines the contact surface thereof to facilitate rotatable sliding, but the flexibility allows partial spring compression only at the contact area.

Although particular embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A chair having a base, a seat, and a tilt control mechanism joined to said base and said seat, said tilt control mechanism comprising a support bearing connected to said base and said seat which permits vertical tilting of said seat relative to said base, and first and second supports fixed respectively to said seat and said base and defining a clearance space therebetween, said first and second supports being movable toward each other as said seat tilts and said tilting mechanism including a resilient member which is supported on one of said first and second supports within said clearance space, said resilient member including a contact surface which is disposed in opposing but spaced apart relation with an opposing surface on the other of said first and second supports, said tilt control mechanism further including a movable insert disposed within said clearance space intermediate of and in contacting relation with said contact surface and said opposing surface such that said resilient member is compressed by tilting movement of said first support relative to said second support, said insert defining a contact area in contact with said contact surface of said resilient member wherein said resilient member is compressed along said contact area during relative movement of said first and second supports to define a tilting resistance, and said tilt control mechanism including an adjustment mechanism for moving said insert along said contact surface to vary said contact area and adjust said tilting resistance.

2. The chair according to claim 1, wherein said resilient member is in a fixed position relative to said support bearing.

3. The chair according to claim 2, wherein said contact surface of said resilient member has a fixed area, said contact area being a portion of said fixed area.

4. The chair according to claim 1, wherein said contact surface is defined on one side by a surface edge which is disposed proximate said insert and said insert has an insert edge which is movable toward and away from said surface edge, said contact area extending uninterrupted between said movable insert edge and said surface edge.

5. The chair according to claim 1, wherein said contact surface and said opposing surface extend vertically.

6. The chair according to claim 5, wherein said insert is movable vertically.

7. The chair according to claim 1, wherein said insert is movable away from said support bearing to increase said contact area and increase said tilting resistance.

8. The chair according to claim 1, wherein said support bearing permits universal tilting and said resilient member is an elastomeric ring, said second support and said insert being annular and being disposed in concentric relation with said elastomeric ring.

9. The chair according to claim 1, wherein said insert is rotatable relative to said resilient member.

10. The chair according to claim 1, wherein said support bearing permits universal tilting and said resilient member is an elastomeric ring, said second support and said insert being annular and being disposed in concentric relation to each other, said insert being movable vertically away from said support bearing to increase said contact area.

11. A chair having a base, seat, and a tilt control mechanism joined to said base and said seat, said tilt control mechanism comprising a support bearing connected to said base and said seat which permits vertical tilting of said seat relative to said base, a support fixed to said base, and an adjustment member supported on said seat such that said support and said adjustment member are movable toward each other during tilting of said seat, said support having a resilient member supported thereon which is disposed between said support and said adjustment member and comprises a resilient material, said resilient member defining a resilient contact surface, said adjustment member including an adjustment surface which is disposed in opposing and contacting relation with said contact surface to act directly on said resilient material during tilting of said seat assembly and said contact surface being resiliently deformable in response to tilting of said seat to define a tilting resistance which opposes said tilting, said tilt control mechanism further including an adjustment device connected to said adjustment member which moves said adjustment member relative to said resilient member at least between a first position defining a contact area comprising a portion of said adjustment surface which contacts said contact surface, said adjustment surface acting on said contact area during tilting wherein said resilient member is deformed along said contact area to define said tilting resistance, and a second position which increases or decreases said contact area to adjust said tilting resistance.

12. The chair according to claim 11, wherein said adjustment member is continuously movable between said first and second positions to continuously vary said contact area.

13. The chair according to claim 12, wherein said contact area extends vertically and said adjustment member is movable vertically by said adjustment device.

14. The chair according to claim 11, wherein said contact area is defined between an edge of said contact surface and a movable edge of said adjustment member.

15. The chair according to claim 14, wherein said support bearing permits universal tilting of said seat relative to said base and said resilient member is an annular elastomeric ring, said adjustment member being annular and disposed in concentric relation with said resilient member, said adjustment surface and said contact surface being disposed in continuous annular contact wherein said contact area extends circumferentially about said resilient member.

16. The chair according to claim 15, wherein said edges of said contact surface and said adjustment member extend horizontally and said adjustment member is movable vertically to adjust a vertical distance between said edges to adjust said contact area.

17. A chair having a base, a seat, and a tilt control mechanism joined to said base and said seat, said tilt control mechanism comprising a support bearing which tiltably connects said seat to said base to permit vertical tilting of said seat and a housing member rigidly connected to said seat so as to tilt relative to said base during tilting movement of said seat, said housing member and said base including opposing contact surfaces which are adjustably overlapped to provide contacting relation with each other and to thus define a contact area therebetween, one of said contact surfaces being defined by a resilient member and the other of said contact surfaces being defined by a rigid member wherein said tilting of said seat effects relative movement of said resilient member and said rigid member toward each other to compress said resilient member and generate a biasing force which is dependent on said contact area and resists tilting of said seat, said chair including a manual actuator which causes relative parallel movement between said opposing contact surfaces to adjust said contact area and thereby adjust said biasing force wherein an increase in said contact area increases said biasing force.

18. The chair according to claim 17, wherein said contact area is adjusted by relative vertical movement of said contact surfaces.

19. The chair according to claim 17, wherein said contact area is adjusted by relative horizontal movement between said contact surfaces.

20. The chair according to claim 17, wherein said resilient member is stationary and said rigid member is movable towards said resilient member during tilting of said seat.

* * * * *